US006607426B2

(12) United States Patent
Suzuki

(10) Patent No.: US 6,607,426 B2
(45) Date of Patent: Aug. 19, 2003

(54) POLISHING APPARATUS

(75) Inventor: Hiroo Suzuki, Kanagawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/986,664

(22) Filed: Nov. 9, 2001

(65) Prior Publication Data

US 2002/0055325 A1 May 9, 2002

(30) Foreign Application Priority Data

Nov. 9, 2000 (JP) ..... 2000-342128

(51) Int. Cl.[7] ..... B24B 7/00
(52) U.S. Cl. ..... 451/56; 451/443; 451/24
(58) Field of Search ..... 451/41, 56, 285, 451/287, 288, 443, 11, 24

(56) References Cited

U.S. PATENT DOCUMENTS 6,336,842 B1 * 1/2002 Ootsuki et al. ..... 451/21
6,354,918 B1 * 3/2002 Togawa et al. ..... 451/56
6,371,838 B1 * 4/2002 Holzapfel ..... 451/72

* cited by examiner

*Primary Examiner*—Eileen P. Morgan
(74) *Attorney, Agent, or Firm*—Wenderoth, Lind & Ponack, L.L.P.

(57) ABSTRACT

A dresser unit including a dresser 20 and a driving shaft 21 for rotationally driving the dresser 20 is operatively mounted to a dresser supporting mechanism so that the dresser unit can be moved up and down freely with respect to the dresser supporting mechanism, wherein a piston-cylinder mechanism 40 is installed between the dresser unit and the dresser supporting mechanism for pushing up the dresser unit by an upward force of fluid pressure, and a fluid at a predetermined pressure level is supplied to the piston-cylinder mechanism 40 from a compressed air source 67 via a pressure control unit 65, the compression force applied to a turntable 10 by the dresser is precisely controlled and adjusted based on a balance between the own weight of the dresser unit and the upward force exerted by the piston-cylinder mechanism 40.

12 Claims, 4 Drawing Sheets

PRESENT INVENTION

PRESENT INVENTION

PNEUMATIC BALANCE

POLISHING APPARATUS

BACKGROUND OF THE INVENTION

The present invention relates to a polishing apparatus using a light-load dresser, the load of which is controlled by its own weight in combination with a fluid pressure.

A manufacturing process of a semiconductor wafer utilizes a polishing apparatus for planarizing and mirror-polishing a surface of the semiconductor wafer. FIG. 4 is a perspective view, illustrating a general configuration of such a polishing apparatus. The polishing apparatus shown in FIG. 4 comprises a turntable 100 equipped with a polishing cloth adhered to its upper surface, defining a polishing cloth face 103, a top ring 111 arranged above said turntable 100, with a semiconductor wafer W being held thereto or sucked under vacuum against a lower surface thereof, and a dresser 121 also arranged above said turntable 100 for dressing the polishing cloth face 103.

In a polishing operation, a polishing slurry is supplied from a slurry supply nozzle 105 onto the polishing cloth face 103 of the turntable 100 driven rotationally by a driving shaft 101, while the semiconductor wafer W held by the top ring 111 is compressed against the polishing cloth face 103 for polishing to a mirror-surface.

In such an apparatus, if slurry collects on and clogs the surface of the polishing cloth forming the polishing cloth face 103, deterioration in polishing performance will result. Thus, pure water, as required, is supplied onto the polishing cloth face 103 of the rotating turntable 100 from a supply means (not shown), while the dresser 121 is rotated and compressed against the polishing cloth face 103, thereby preventing slurry from clogging (i.e. regenerating the polishing cloth), and maintaining a working condition of the polishing cloth face 103. In such an apparatus, the dresser 121 serves as a tool for abrading the polishing cloth face 103 slightly by a unit of $\mu$m ($10^{-6}$ m) or as a tool-for cleaning the polishing cloth face 103.

FIG. 3 shows a dresser driving mechanism of a pneumatic balance control type according to a conventional technology. As shown in FIG. 3, the conventional dresser 121 has its driving shaft 123 operatively attached to an end portion of a swing arm 125 so as to be moved up and down freely with respect to the swing arm 125, and the entire unit of the mechanism can be swingably moved together with the swing arm 125 upon a swinging motion of a support pole 127 of the swing arm 125. The driving shaft 123 is rotationally driven by a motor 129 through a driving belt 131. Further, a dresser driving cylinder 132 is mounted on the swing arm 125, and pneumatic pipes 135 and 137 are respectively connected to chambers "a" and "b" defined within the cylinder 132 on opposite sides of a piston 133. The upper pneumatic pipe 137 is connected to a three-way electromagnetic valve 139 via a throttle valve 138 for restricting an air flow rate. A pneumatic pipe 137*a* for supplying compressed air and a pneumatic pipe 137*b* for exhausting the air are connected to the three-way electromagnetic valve 139; and further the pneumatic pipe 137*a* is connected to a pressure control unit 141; while the lower pneumatic pipe 135 is connected to a relief valve 147 via throttle valves 143 and 145. The relief valve 147 also functions to control a fluid pressure at a constant level.

The pressure control unit 141 functions to decrease a pressure of the supplied compressed air at a predetermined level, and supplying it to the chamber "b" of the cylinder 132, while the relief valve 147 functions to relieve the air gradually from the chamber "a" of the cylinder 132. The pressure control unit 141 also has a function similar to that of the relief valve 147.

When the dresser 121 is moved up, the compressed air at the predetermined level is supplied through the pneumatic pipe 135 into the chamber "a" of the cylinder 132 while the chamber "b" of the cylinder 132 being in communication with the exhaust pipe 137*b* through the three-way electromagnetic valve 139. When the dresser 121 is to be moved down, the chamber "b" is in communication with the pressure control unit 141 through the three-way valve 139 and the compressed air is supplied into the chamber "b" so that the piston 133, and thus the dresser 121, is moved downward. The pressure of the dresser 121 applied to the polishing cloth face 103 of the turntable 100 may be adjusted by controlling a pressure balance of the compressed air supplied into both of chamber "a" and "b" of the cylinder 132.

If the dresser 121 abrades the polishing cloth face 103 of the turntable 121 by a large amount, the polishing cloth face 103 is likely to become worn rapidly and be required to replaced frequently. Thus, preferably the dresser 121 should abrade the polishing cloth face 103 by only a small amount so as to extend the life of the polishing cloth. In addition, if the load applied to the polishing cloth face 103 changes during dressing, amount of abrasion of the polishing cloth face 103 will vary, and the condition on the polishing cloth face 103 will be subject to variation resulting in a serious affection to the ability to polish the semiconductor wafer properly. From that point of view, such a dresser 121 has been desired that can maintain the light-load condition stably and can make an amount of abrasion of the polishing cloth face 103 to be as small as possible and also constant.

However, in the conventional dresser driving mechanism of a pneumatic balance control type described above, two pneumatic circuits consisting of two compressed air supplying systems are used and the load applied to the dresser 121 is determined by the balance in air pressure between the two systems. Therefore, the air pressure in the two systems cannot easily be controlled simultaneously with a high degree of precision, and accordingly, it has been difficult to maintain the dresser 121 in a constant light-load condition stably during dressing.

Further, there have been other problems such that upon moving the dresser 121 down, the relief valve 147 moves out of its operational limit due to very light air pressure applied thereto and which prohibits air relief and results in a failure of the downward movement of the dresser 121. Additionally upon moving the dresser 121 down, the chamber "a" of the cylinder 132 is scarcely exhausted and thus the dresser 121 exhibits a discontinuous downward motion in a repetitive downward and stopping motions, cyclically.

SUMMARY OF THE INVENTION

The present invention has been made in the light of the problems described above, and an object thereof is to provide a polishing apparatus equipped with a light-load dresser capable of a precisely controlled light-load and achieving a smooth downward movement operation.

The present invention takes advantage of the mass of a dresser itself having a constant load in combination with a force provided by a single variable fluid pressure and thereby achieves precise control of the light load of the dresser.

That is, in order to solve the problems described above, the present invention provides a polishing apparatus comprising a turntable, a top ring and a dresser, each of which is rotatable independently, with an object to be polished being interposed between the turntable and the top ring so that a surface of the interposed object can be polished by a polishing cloth face defined on said turntable surface, wherein the polishing cloth face can be regenerated by compressing the dresser against the turntable, the apparatus characterized in that: a dresser unit including the dresser and a shaft for rotatably supporting the dresser is operatively mounted to a dresser supporting mechanism so as to be moved up and down freely with respect to the dresser supporting mechanism, and a push-up mechanism is installed between the dresser unit and said dresser supporting mechanism for pushing the dresser unit with an upward force, wherein a compression force applied by the dresser against the turntable can be adjusted by a balance between an own weight of the dresser unit itself and the upward force provided by the push-up mechanism. This upward force can be generated by a fluid pressure. Further, the shaft can be a driving shaft for rotationally driving the dresser.

Still further, the push-up mechanism may comprise: an elevating mechanism consisting of a piston-cylinder mechanism installed between the dresser unit and the dresser supporting mechanism; with a fluid supplying mechanism for supplying a fluid at a predetermined pressure level to the elevating mechanism, the fluid supplying mechanism supplying the fluid at the predetermined pressure level to one of the chambers within the cylinder divided by the piston of the elevating mechanism, while relieving the pressure in the other of the chambers so as to generate an upward force applied to the dresser unit.

Still further, the fluid supplying mechanism may comprise: a compressed fluid source connected to the one of the chambers of the cylinder of the elevating mechanism through a pipe; and a pressure control unit installed within the pipe for depressing the compressed fluid supplied from the compressed fluid source to the predetermined pressure level and supplying the depressed fluid to the one of the chambers of the cylinder.

DETAILED DESCRIPTION OF THE PREFERRED EMBODIMENTS

Preferred embodiments of the present invention will now be described with reference to the attached drawings.

Figure 1:
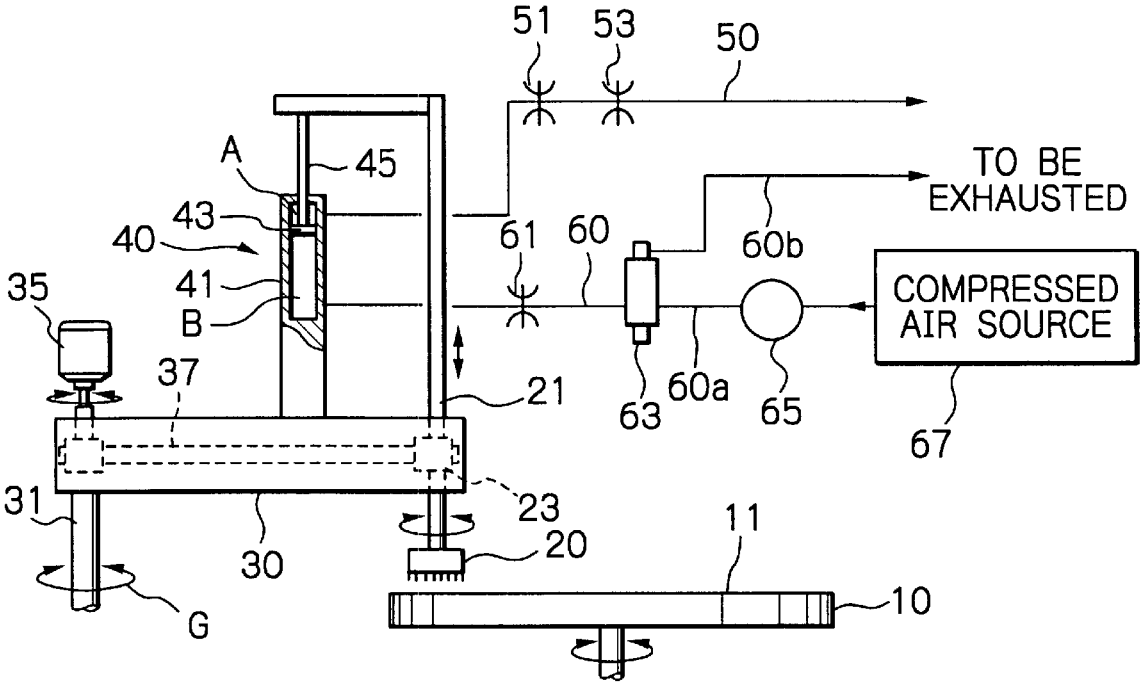
FIG. 1 is a schematic diagram illustrating a dresser driving mechanism of a mass application type according to a first embodiment of the present invention.

FIG. 1 is a diagram showing a dresser driving mechanism of a mass application type according to an embodiment of the present invention. As shown in FIG. 1, the dresser 20 has a drive shaft 21 operatively mounted to a swing arm 30 near one end portion thereof so that the drive shaft 21 can be moved up and down freely with respect to the swing arm 30. When a support pole 31 fixed to the swing arm 30 near at the other end portion thereof is swang in the direction as indicated by the arrow "G" by a rotationally driving mechanism, though not shown, the dresser 20, the driving shaft 21 and a piston-cylinder mechanism 40, which will be described later, are rotated as a unit in accordance with the rotary motion of the support pole 31. The driving shaft 21 is rotationally driven by a motor 35 through a driving belt 37, while a pulley 23, on which the belt 37 is wrapped, is operatively mounted on the driving shaft 21 so that the pulley 23 can rotate together with the driving shaft 21 but would not follow the up-and-down movement of the driving shaft 21.

The piston-cylinder mechanism (an elevating mechanism) 40 is mounted on or fixed to the swing arm 30. The piston-cylinder mechanism 40 comprises a cylinder 41 which is fixedly mounted on the swing arm 30 and a piston 43 which divides an interior of the cylinder 41 into two chambers "A" and "B" and moves up or down depending on an air pressure in respective chambers "A" and "B". A rod 45 of the piston 43 is operatively coupled to said driving shaft 21 so that the rod 45 can move up or down together with the driving shaft 21 when it moves up or down, but so that the rod 45 does not follow the rotating movement of the driving shaft 21. The embodiment shown employs a low frictional sliding material with low frictional resistance capable of bearing repetitive operations as materials for sliding members of the piston cylinder mechanism so that the piston 43 can be operated even under extremely low pneumatic pressure, and has longer life.

Further, pneumatic pipes 50 and 60 are connected respectively to the chambers A and B of the cylinder 41. The upper pneumatic pipe 50 is open to the ambient via two throttle valves 51 and 53 for restricting the air flow therethrough. The lower pneumatic pipe 60 is connected to a three-way electromagnetic valve 63 via a similar throttle valve 61. A pneumatic pipe 60*a* for supplying compressed air and a pneumatic pipe 60*b* for exhausting the air are connected to the three-way electromagnetic valve 63. The pneumatic pipe 60*a* is connected to an air pressure control unit 65 and the air pressure control unit 65 is connected to a compressed air source (a compressed fluid source) 67.

Herein, the three-way electromagnetic valve 63 is designed to be a switching valve for selectively establishing communication between the pneumatic pipe 60 and the pneumatic pipe 60*a* or that between the pneumatic pipe 60 and the pneumatic pipe 60*b*. Further, the pressure control unit 65 functions to decompress the compressed air supplied from the compressed air source 67 to a predetermined pressure level and supplies the decompressed air into the chamber B of the cylinder 41.

As described above, in the present embodiment, the pneumatic pipe 50 is open to ambient air and the apparatus includes the only one system for supplying pressurized air in the side of the pneumatic pipe 60 (i.e., the hydraulic circuit operating in a direction for lifting up the dresser unit). Incidentally herein, the term, dresser unit, designates an entire unit of those members which move up or down together with the dresser 20 with respect to the dresser supporting mechanism i.e. the swing arm 30, and in the embodiment shown, it refers to the unit including the dresser 20, the driving shaft 21, the rod 45 and the piston 43. That is, the dresser unit means the entire unit of the members whose total weight contribute to a load applied so as to compress the surface of the turntable 10.

An operation of the dresser 20 will now be described. At first, when the dresser 20 is to be lifted up, the three-way electromagnetic valve 63 is controlled so that the pneumatic pipe 60 to come into communication with the pneumatic pipe 60*a*, and the compressed air that has been controlled to the predetermined pressure level by the pressure control unit 65 is supplied to the chamber B of the cylinder 41. Thereby, the piston 43 and the dresser 20 are moved upward.

On the other hand, in the case where a dressing operation is to be applied to a polishing cloth face (a polishing face) 11 of the turntable 10, the swing arm 30 is swingingly moved in the direction designated by the arrow G to position the dresser 20 at a predetermined location over the turntable 10, and at the same time the motor 35 is driven so as to rotate the driving shaft 21 and the dresser 20. Subsequently, the pressure control unit 65 is actuated to decompress the compressed air to be supplied from the compressed air source 67 to the chamber B of the cylinder 41 to a predetermined level so that the air in the chamber B is exhausted, and thereby the dresser 20 is moved downward by its own weight and comes into contact with the polishing cloth face 11 of the rotating turntable 10. Then, the pressure of the compressed air supplied to the chamber B is further controlled by the pressure control unit 65, so that the dresser 20 can be compressed against the turntable 10 with a predetermined light-load produced from the balance between the own weight of the whole dresser unit and the upward force provided by the compressed air within the chamber B, while the dresser 20 is rotationally driven to apply the dressing operation to the polishing cloth face 11 of the turntable 10.

When it is desired that the dresser 20 is moved down to the surface of the turntable 10 at an appropriate speed, the three-way electromagnetic valve 63 is controlled to establish the communication between the pneumatic pipe 60 and the pneumatic pipe 60*b* so that the air pressure within the chamber B is made equal to that within the chamber A, whereby the dresser is able to move downward under its own weight. The air release rate is adjusted beforehand by means of the throttle valve 61.

Figure 3:
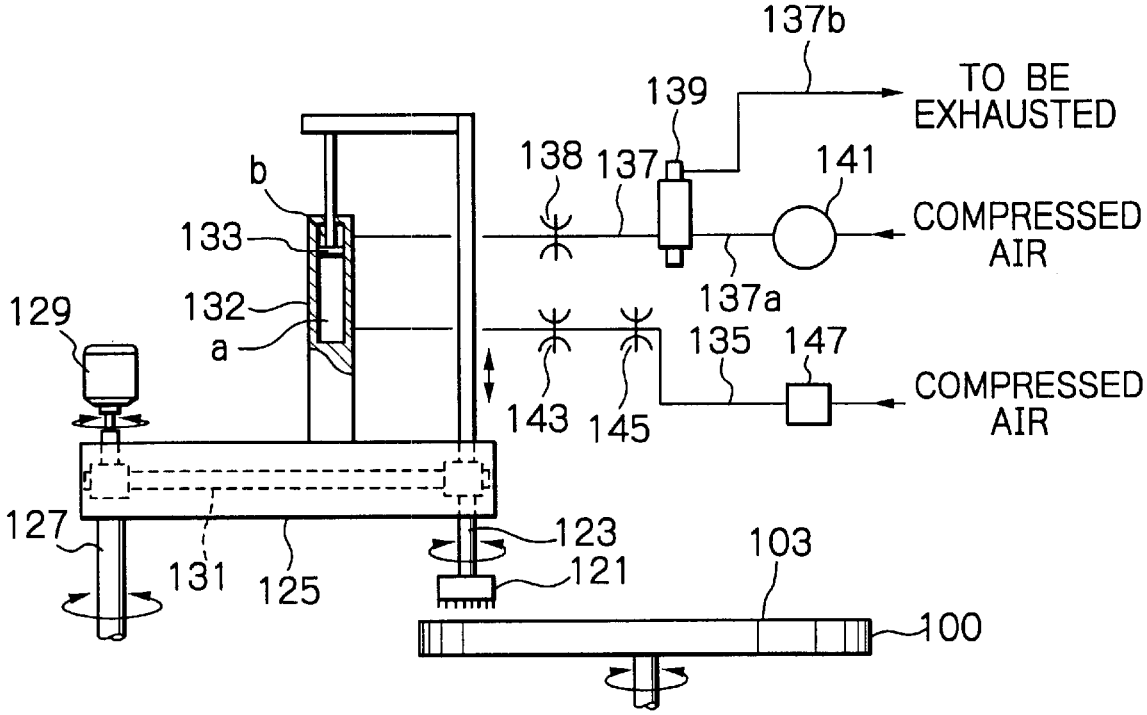
FIG. 3 is a schematic diagram of a dresser driving mechanism of pneumatic balance control type according to the prior art.

When, the dresser 20 is moved downward at the appropriate speed and reaches a terminating position approaching the polishing cloth surface 11, the downward movement mode is preferably switched to a mode which establishes a appropriate dressing load. To this end, the sensor (not shown) is provided to detect a downward movement terminating position While the dresser 20 is moving down, the opening of the throttle valve 61 is adjusted such that the flow rate for releasing the air from the chamber B of the cylinder 41 through the pneumatic pipe 60 is appropriate for controlling a downward movement speed. When the sensor detects the downward movement terminating position of the dresser 20, the three-way electromagnetic valve 63 is switched over and the air pressure to be supplied to the cylinder 41 is precisely controlled by the pressure control unit 65 to produce a force able to support the dresser unit upwardly to obtain a suitable dressing load. That is, in the present invention, a light load generated by the difference between the (constant) downward weight of the dressing unit and the upward supporting force generated by a fluid pressure of the single pneumatic system can be stably maintained during a dressing treatment and is applied to the polishing cloth face 11. That is, as compared with the dresser driving mechanism comprising two pneumatic systems described with reference to the prior-art example as illustrated in FIG. 3, an error in control pressure can be decreased by half.

Further, according to the present invention, the entire weight of the dresser unit itself may be effectively applied in a downward direction by relieving air pressure in the chamber B of the cylinder 41 during downward movement of the dresser 20. Accordingly, the apparatus of the present invention, even under a light-load, can eliminate a problem where as a result of static frictional resistance of the sliding contact portion of the cylinder, fluid in the pneumatic circuit is unable to be released and thus the dresser unit is prevented from moving down. In order to adjust the entire weight of the dresser unit itself, a variety of methods including an installation of weights or pulleys are conceivable.

Figure 2:
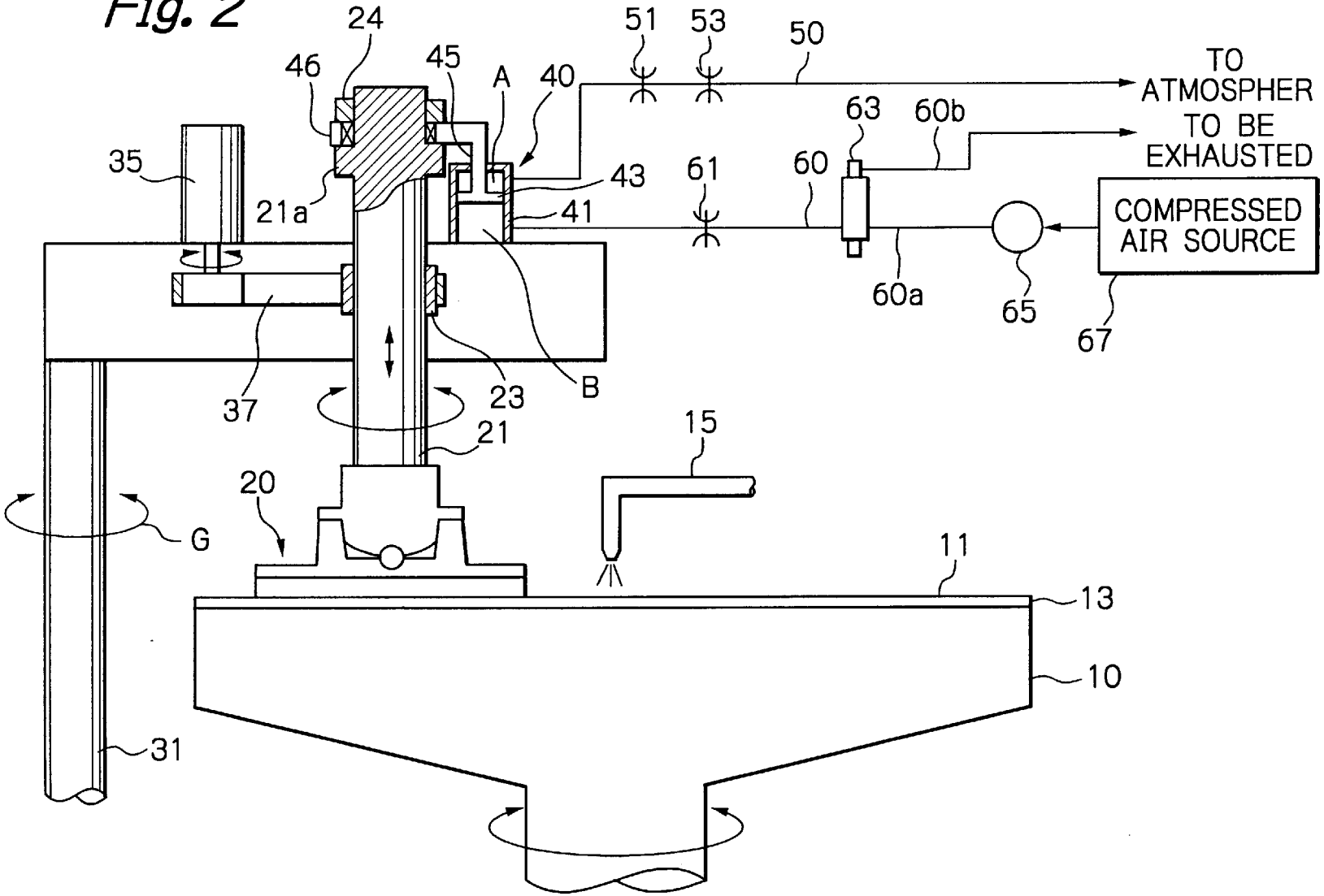
FIG. 2 is a schematic diagram of the dresser driving mechanism of FIG. 1, illustrating said mechanism as a more specified unit.

FIG. 2 schematically shows a dresser driving mechanism, wherein the dresser driving mechanism shown in FIG. 1 is illustrated as a specified unit. In this figure, the same parts as those shown in FIG. 1 are designated using the similar reference numerals, and detailed description is omitted.

Figure 4:
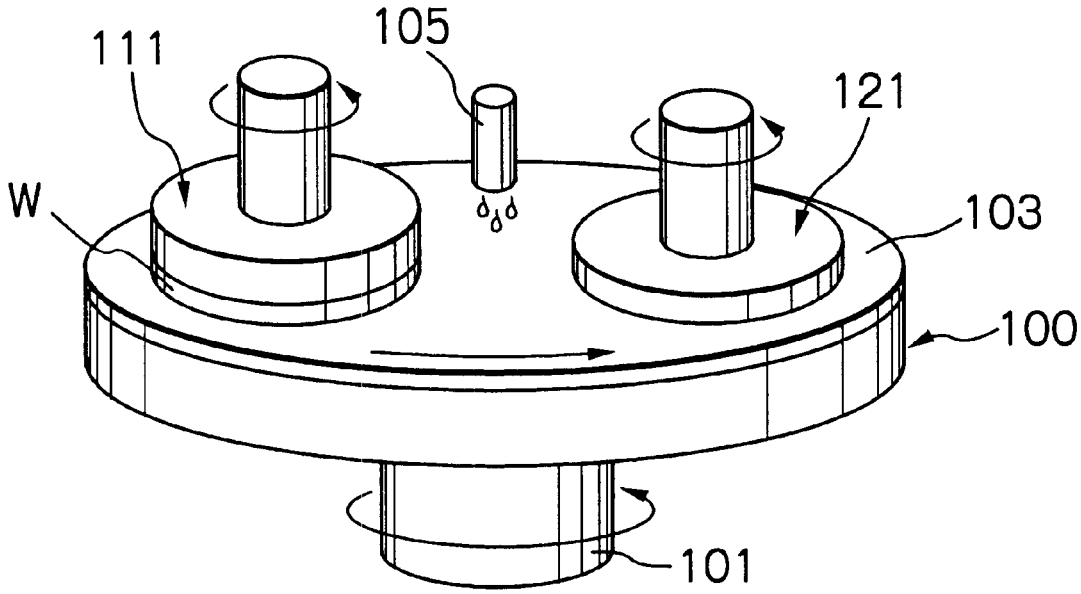
FIG. 4 is a perspective view, illustrating a general configuration of a polishing apparatus.

As shown in FIG. 2, a surface of a turntable 10 is equipped with a polishing cloth 13 adhered to define a polishing cloth face 11. A dressing liquid supply nozzle 15 is provided above the turntable 10 to supply a pure water or the like as a dressing fluid. A pulley 23 for rotationally driving a driving shaft 21 of a dresser 20 and the driving shaft 21 are operatively coupled by a mechanism such as spline fitting, thereby enabling the pulley 23 and the driving shaft 21 to rotate together, while the pulley 23 is able to slide in a longitudinal direction of the driving shaft 21. Further, a rod 45 of a piston 43 is operatively coupled with the driving shaft 21 by means of a bearing mechanism 46 such as a ball bearing which is held between a projection 21*a* of tie driving shaft 21 and a fixing nut 24, to enable those members to be moved as a single in the longitudinal direction, while the driving shaft 21 is able to independently rotate in a rotating direction thereof with respect, to the rod 45 by the bearing mechanism 46. It is to be noted that a top ring 111 holding such a semiconductor wafer W as shown separately in FIG. 4 is also arranged on the turntable 10, though not illustrated.

While preferred embodiments of the present invention have been described, the present invention is not limited to these embodiments, and various modifications can be applied without departing from the scope or spirit of the present invention as defined in the appended claims, specification and drawings. It should be appreciated that any configurations, structures or materials that have not been directly referred to in the specification or drawings are included in the scope of the inventive concept of the present invention so far as the same operations and effects as those attainable by the present invention can be realized. For example, although in the above embodiments air is used as a working fluid, a variety of different fluids such as $N_2$ gas, oxygen gas or the like other than the air may be used.

According to the present invention as described above, since the load compressing the dresser against the turntable can be controlled by the balance between the own weight of the dresser unit and the dresser unit upwardly supporting force provided by the fluid pressure, advantageously a precisely controlled load can be effectively and stably obtained.

Further, since the entire weight of the dresser unit itself can be effectively applied downward only by relieving a fluid pressure during downward movement of the dresser, the apparatus of the present invention, even with a light load, is able to eliminate problem that under a static frictional resistance of respective portions of the mechanism, the fluid is unable to be released and accordingly the dresser unit is prevented from being moved down or from moving in a downward direction discontinuously, thereby bringing about an advantageous effect that the dresser unit can be operated in a downward direction continuously. In above-mentioned description, polishing surface of the turntable is made of polishing cloth. But, the polishing surface is not necessarily made of polishing cloth. For example, the polishing surface can be made of fixed abrasive formed by resin.

Also, linear direction moving polishing belt(web) is applied to the polishing surface.

What is claimed is:

1. A polishing apparatus comprising:

a dresser unit including a dresser for regenerating a polishing surface and a shaft for rotatably supporting said dresser;

a dresser supporting mechanism being mounted to said shaft, wherein said shaft moves up and down freely with respect to said dresser supporting mechanism; and a push-up mechanism being installed between said dresser unit and said dresser supporting mechanism, said push-up mechanism being operable to push said dresser unit with an upward force, wherein a compression force applied by said dresser against the polishing surface is based solely on a weight of said dresser unit and the upward force of said push-up mechanism.

2. A polishing apparatus in accordance with claim 1, wherein the upward force is generated by fluid pressure.

3. A polishing apparatus in accordance with claim 1, wherein said shaft is a driving shaft operable to rotationally drive said dresser.

4. A polishing apparatus in accordance with claim 1, wherein said push-up mechanism comprises:

an elevating mechanism comprising a piston-cylinder mechanism having a piston dividing a cylinder into two chambers, said piston-cylinder mechanism being installed between said dresser unit and said dresser supporting mechanism; and a fluid supplying mechanism being operable to supply a fluid at a predetermined pressure level to said elevating mechanism, wherein said fluid supplying mechanism supplies the fluid at the predetermined pressure level to a first of said two chambers within said cylinder, while relieving a pressure in a second of said two chambers to generate the upward force applied to said dresser unit.

5. A polishing apparatus in accordance with claim 4, wherein said fluid supplying mechanism comprises:

a pipe;

a compressed fluid source connected to said first of said two chambers of said cylinder of said elevating mechanism through said pipe; and a pressure control unit installed within said pipe, said pressure control unit being operable to depress the fluid supplied from said compressed fluid source to the predetermined pressure level and supply the depressed fluid to said first of said two chambers of said cylinder.

6. A polishing apparatus in accordance with claim 2, wherein said shaft is a driving shaft being operable to drive said dresser.

7. A polishing apparatus in accordance with claim 2, wherein said push-up mechanism comprises:

an elevating mechanism comprising a piston-cylinder mechanism having a piston dividing a cylinder into two chambers, said piston-cylinder mechanism being installed between said dresser unit and said dresser supporting mechanism; and a fluid supplying mechanism being operable to supply a fluid at a predetermined pressure level to said elevating mechanism, wherein said fluid supplying mechanism supplies the fluid at the predetermined pressure level to a first of said two chambers within said cylinder, while relieving a pressure in a second of said two chambers to generate the upward force applied to said dresser unit.

8. A polishing apparatus in accordance with claim 3, wherein said push-up mechanism comprises:

an elevating mechanism comprising a piston-cylinder mechanism having a piston dividing a cylinder into two chambers, said piston-cylinder mechanism being installed between said dresser unit and said dresser supporting mechanism; and a fluid supplying mechanism being operable to supply a fluid at a predetermined pressure level to said elevating mechanism, wherein said fluid supplying mechanism supplies the fluid at the predetermined pressure level to a first of said two chambers within said cylinder, while relieving a pressure in a second of said two chambers to generate the upward force applied to said dresser unit.

9. A polishing apparatus in accordance with claim 6, wherein said push-up mechanism comprises:

an elevating mechanism comprising a piston-cylinder mechanism having a piston dividing a cylinder into two chambers, said piston-cylinder mechanism being installed between said dresser unit and said dresser supporting mechanism; and a fluid supplying mechanism being operable to supply a fluid at a predetermined pressure level to said elevating mechanism, wherein said fluid supplying mechanism supplies the fluid at the predetermined pressure level to a first of said two chambers within said cylinder, while relieving a pressure in a second of said two chambers to generate the upward force applied to said dresser unit.

10. A polishing apparatus in accordance with claim 7, wherein said fluid supplying mechanism comprises:

a pipe;

a compressed fluid source connected to said first of said two chambers of said cylinder of said elevating mechanism through said pipe; and a pressure control unit installed within said pipe, said pressure control unit being operable to depress the fluid supplied from said compressed fluid source to the predetermined pressure level and supply the depressed fluid to said first of said two chambers of said cylinder.

11. A polishing apparatus in accordance with claim 8, wherein said fluid supplying mechanism comprises:

a pipe;

a compressed fluid source connected to said first of said two chambers of said cylinder of said elevating mechanism through said pipe; and a pressure control unit installed within said pipe, said pressure control unit being operable to depress the fluid supplied from said compressed fluid source to the predetermined pressure level and supply the depressed fluid to said first of said two chambers of said cylinder.

12. A polishing apparatus in accordance with claim 9, wherein said fluid supplying mechanism comprises:

a pipe;

a compressed fluid source connected to said first of said two chambers of said cylinder of said elevating mechanism through said pipe; and a pressure control unit installed within said pipe, said pressure control unit being operable to depress the fluid supplied from said compressed fluid source to the predetermined pressure level and supply the depressed fluid to said first of said two chambers of said cylinder.

* * * * *